US006727827B1

(12) United States Patent
Edwards et al.

(10) Patent No.: US 6,727,827 B1
(45) Date of Patent: Apr. 27, 2004

(54) MEASUREMENT WHILE DRILLING ELECTROMAGNETIC TELEMETRY SYSTEM USING A FIXED DOWNHOLE RECEIVER

(75) Inventors: John E. Edwards, Bieldside (GB); Brian Clark, Sugar Land, TX (US); John R. Lovell, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 714 days.

(21) Appl. No.: 09/639,210

(22) Filed: Aug. 15, 2000

Related U.S. Application Data

(60) Provisional application No. 60/151,532, filed on Aug. 30, 1999.

(51) Int. Cl.[7] ..... G01V 3/00

(52) U.S. Cl. ..... 340/854.9; 340/854.4; 367/82; 324/339; 324/345

(58) Field of Search ..... 340/854.9, 854.6, 340/854.5, 854.4; 367/82; 324/344, 345, 346, 339

(56) References Cited

U.S. PATENT DOCUMENTS

| | | | | |
|---|---|---|---|---|
| 3,746,106 | A | 7/1973 | McCullough et al. | |
| 5,233,304 | A | 8/1993 | Hubans | |
| 5,512,889 | A | 4/1996 | Fletcher | |
| 5,563,512 | A * | 10/1996 | Mumby | 324/339 |
| 5,767,680 | A | 6/1998 | Torres-Verdin et al. | |
| 6,018,501 | A | 1/2000 | Smith et al. | |
| 6,191,586 | B1 * | 2/2001 | Bittar | 324/339 |
| 6,300,762 | B1 * | 10/2001 | Thomas, Jr. et al. | 324/339 |

FOREIGN PATENT DOCUMENTS

| | | |
|---|---|---|
| EP | 0 945 590 A2 | 9/1999 |
| EP | 0 984 135 A2 | 3/2000 |
| EP | 0 984 135 A3 | 8/2000 |
| GB | 2 164 681 A | 3/1986 |
| GB | 2 292 869 A | 3/1996 |
| GB | 2 299 915 B | 10/1996 |
| GB | 2 337 546 A | 11/1999 |
| WO | WO 97/21117 | 6/1997 |
| WO | WO 00/00850 | 1/2000 |
| WO | WO 01/65066 A1 | 9/2001 |

* cited by examiner

*Primary Examiner*—Timothy Edwards
(74) *Attorney, Agent, or Firm*—Victor H. Segura; Brigitte L. Jeffery; John J. Ryberg

(57) ABSTRACT

A system and method for enhancing the reception of electromagnetic (EM) waves in a fixed downhole receiver of an EM telemetry system is provided. In one embodiment, slots are formed in a portion of an outer casing and an EM receiver is positioned within the outer casing so as to be aligned with the slots formed therein. In another embodiment, an inductive coupling arrangement is provided to transfer signals from an EM receiver mounted on the outside surface of an outer casing to a wireline that is attached to the outer surface of an inner casing, which is disposed within the outer casing. In yet another embodiment, an insulated gap is formed in the surface of the outer casing. An EM receiver, mounted on the outer surface of the inner casing, is positioned above the insulated gap of the outer casing. An electrical coupling mechanism is further provided to electrically couple the inner and outer conductors at a point above the EM receiver.

39 Claims, 17 Drawing Sheets

MEASUREMENT WHILE DRILLING ELECTROMAGNETIC TELEMETRY SYSTEM USING A FIXED DOWNHOLE RECEIVER

CROSS-REFERENCES

This application claims priority of U.S. Provisional Application No. 60/151,532, filed on Aug. 30, 1999, entitled "MWD EM Telemetry System Using a Fixed Downhole Receiver."

BACKGROUND OF THE INVENTION

1. Field of the Invention

The present invention relates generally to electromagnetic (EM) telemetry, and, more particularly, to a method and apparatus for facilitating EM wave reception of drilling and geological data in a fixed downhole receiver of an EM telemetry system. The invention has general application in the field of hydrocarbon exploration and production.

2. Description of Related Art

In standard practice, EM telemetry systems transmit drilling and geological data from downhole tools, such as a measurement-while-drilling (MWD) tool, to a location at the surface for analysis. The drilling and geological data usually provides important information regarding any potential problems that may occur during downhole operations. For example, the data characterizing the downhole conditions may indicate the production of water or sand, in which case, immediate notification of such is desired in order that corrective action may be taken. Accordingly, it is important to receive this downhole data at the surface in an accurate and expeditious manner to optimize operational response to any potential problems.

Currently, EM telemetry is generally limited to shallow land rigs where the formations are quite resistive (i.e., on the order of ten ohm-m or more). In a conventional EM telemetry system, an MWD tool includes a transmitter to transmit drilling and geological data to a receiver, which is typically located on the surface near the drilling rig. The transmitter of the MWD tool broadcasts a low frequency EM wave, typically in the tens of Hz or less. For a shallow and relatively high resistive formation, the current EM transmission scheme will typically suffice for conveying this data to the drilling surface.

In an offshore drilling operation, however, the EM wave will typically pass through thousands of feet of low resistivity formations of about 1 ohm-m, and then through hundreds to thousands of feet of salt water, having a resistivity of about 0.2 ohm-m, before reaching the receiver on the surface. Under the current EM telemetry scheme, however, the attenuation of the EM wave is too high for this approach to be practical. Moreover, the receiver being located on the drilling surface is typically subjected to high ambient EM noise from the drilling rig itself, thus further complicating the matter.

GB 2299915B to K. Babour (assigned to the present assignee) describes an alternative approach to placing the EM receiver at the surface. Babour proposes placing an EM receiver on the riser or on the platform itself. Even in such cases, however, the received EM signal might be quite small because of a likely low resistivity in those rock formations near the seabed. The method of Babour has been modified in U.S. Pat. No. 6,018,501, to Smith et al., to transmit the received EM signal from the seabed via an acoustic retransmission to a surface receiver. EP 0945590 A2 to Harrison proposes receiving the signal along an electrical conduit from a seabed template for transmission to the surface. Neither of these proposed techniques addresses the issue that the original EM signal received is small. Because it is important to receive the drilling and geological data accurately and expeditiously at the surface to take immediate corrective action for any problems that may occur during the downhole operations, an EM telemetry scheme which relies upon receivers near or above the seabed will not suffice for accomplishing such while drilling in deeper formations.

The present invention is directed to overcoming, or at least reducing the effects of, one or more of the problems set forth above.

SUMMARY OF THE INVENTION

In one aspect of the invention, a downhole telemetry system is provided. The system includes a first tubular disposed within a borehole, the first tubular having an elongated body and including at least one slot formed in a portion thereof. A second tubular is also disposed within the first tubular. The second tubular having a receiver, adapted to receive a signal, mounted thereon and positioned within the first tubular such that the receiver is aligned with the at least one slot formed in the first tubular.

In another aspect of the invention, a method for downhole telemetry is provided. The method includes disposing a first tubular within a borehole, the first tubularlincluding at least one slot formed in a portion thereof. A second tubular is disposed within the first tubular, the second tubular having at least one receiver mounted on its outer surface. The second tubular is positioned within the first tubular such that the at least one receiver is aligned with the slotted portion of the first tubular, and a signal is received at the at least one receiver.

In another aspect of the invention, a system for downhole telemetry is provided. The system includes a first tubular disposed within a borehole and a second tubular being disposed within the first tubular, the second tubular having a wireline attached to its outer surface. A receiver is provided and adapted to receive a signal, the receiver being mounted on the outer surface of the first tubular. A first coupler is mounted on the outer surface of the first tubular and connected to the receiver, and a second coupler is mounted on the outer surface of the second tubular and connected to the wireline. The first coupler is adapted to transfer the signal received by the receiver to the wireline via the second coupler.

In another aspect of the invention, a method for downhole telemetry is provided. The method includes mounting a first inductive coupler and a receiver on the outer surface of a first tubular, the first inductive coupler and receiver being connected to each other. A second inductive coupler is mounted on the outer surface of a second tubular. The second tubular is disposed within the first tubular, and a first signal is received at the receiver and transferred from the first inductive coupler to the second inductive coupler.

In another aspect of the invention, a method for downhole telemetry is provided. The method includes mounting a first inductive coupler and a transceiver on the outer surface of a first tubular, the first inductive coupler and transceiver being connected to each other. A second inductive coupler is mounted on the outer surface of a second tubular. The second tubular is disposed within the first tubular, and a first signal is received at the transceiver and transferred from the first inductive coupler to the second inductive coupler.

In another aspect of the invention, a system for downhole telemetry is provided. The system includes a first tubular disposed within a borehole, the first tubular having an elongated body and including an insulated gap formed in a portion thereof. A second tubular is disposed within the first tubular, the second tubular having a receiver mounted on its outer surface. An electrical coupling mechanism is further provided and adapted to electrically couple the first tubular to the second tubular. The second tubular is positioned within the first tubular such that the electrical coupling mechanism is positioned above the receiver on the second tubular and the receiver is positioned above the insulated gap formed in the first tubular.

In another aspect of the invention, a method for downhole telemetry is provided. The method includes disposing a first tubular within a borehole, the first tubular having an elongated body and including an insulated gap formed in a portion thereof. A second tubular is disposed within the first tubular, the second tubular having a receiver mounted on its outer surface. The second tubular is positioned with the first tubular such that the receiver mounted on its surface is positioned above the insulated gap formed in the first tubular. The first tubular is electrically coupled to the second tubular, with the electrical coupling occurring above the receiver mounted on the second tubular.

BRIEF DESCRIPTION OF THE DRAWINGS

The invention may be understood by reference to the following description taken in conjunction with the accompanying drawings, in which like reference numerals identify like elements, and in which.

DETAILED DESCRIPTION OF SPECIFIC EMBODIMENTS

Figure 1:
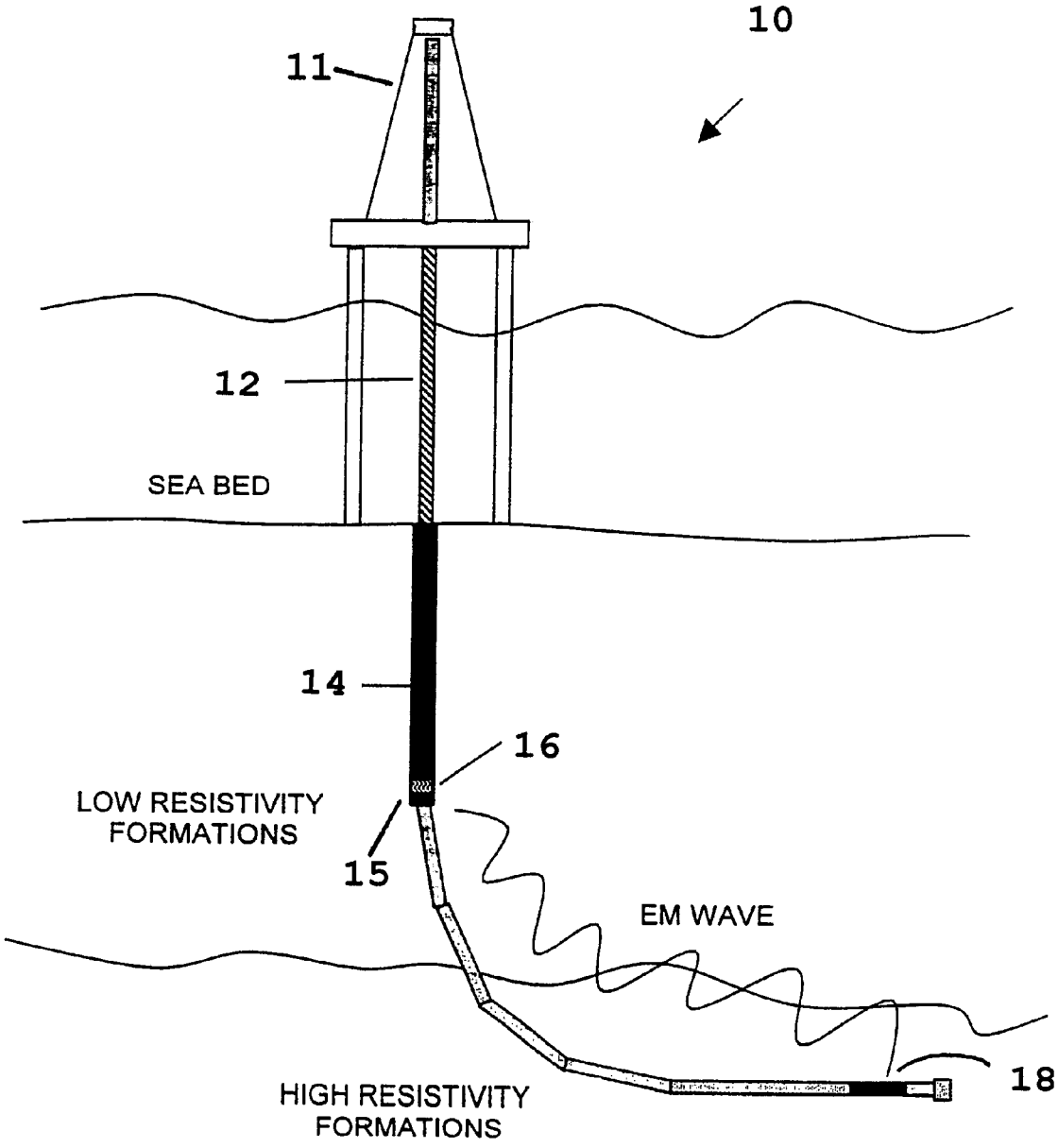
FIG. 1 shows a drilling and electromagnetic telemetry system in accordance with one embodiment of the present invention.

FIG. 1 shows an EM telemetry system 10 in accordance with one embodiment of the invention. The system 10 includes a drilling rig 11 and a riser 12, which extend from the earth's surface. According to one embodiment, the drilling rig 11 is deployed off shore and extends from a sea bed. The drilling rig 11 creates a borehole into the earth and a metallic outer casing 14, commonly known as a "tubular," is disposed within the borehole and cemented therein.

According to one embodiment of the invention, the outer casing 14 includes a slotted section 15 in which an EM receiver 16 is disposed. An EM transmitter 18 is deployed near a MWD tool (not shown), which collects drilling and geological data related to the drilling operation. The EM transmitter 18 transmits the drilling and geological data via electromagnetic waves, which are received by the EM receiver 16 through the slotted section 15 of the outer casing 14. The receiver 16 subsequently sends the received drilling and geological data to a remote location at the drilling surface, where it is collected and analyzed.

In accordance with another embodiment of the invention, the EM receiver 16 may alternatively be mounted on the outside surface of the outer casing 14 as opposed to being disposed within the outer casing 14. In another embodiment, the EM receiver 16 and EM transmitter 18 may be configured as transceivers (i.e., transmitter/receiver) such that they both have transmitting and receiving capabilities. For example, if data sent from the EM transmitter 18 to the EM receiver 16 is transmitted on a weak signal, the EM receiver 16 may have the capability to transmit a downlink command to the transmitter 18 to boost its signal strength.

Figure 2:
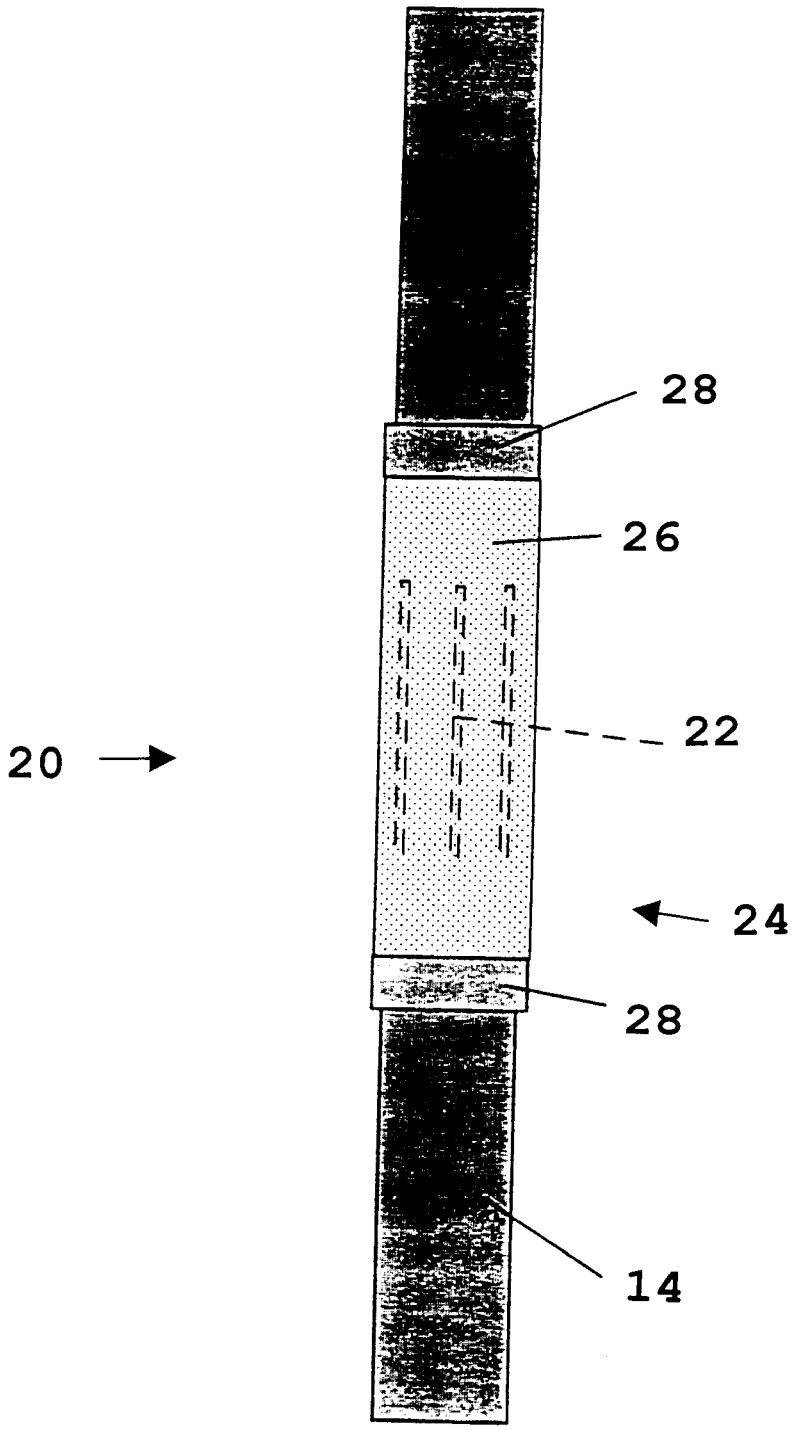
FIG. 2 provides a side-view perspective of an outer casing with a plurality of axial slots formed therein according to one embodiment.

Turning now to FIG. 2, a side view of the tubular outer casing 14 is shown in accordance with one embodiment of the invention. The outer casing 14 includes a slotted station 20 having axial slots 22 that are cut through its tubular wall, with each axial slot 22 fully penetrating the tubular wall of the outer casing 14. The purpose of the axial slots 22 is to allow EM radiation to propagate through the outer casing 14 in a mode known as a transverse electric (TE) mode (i.e., to permit maximum passage of TE radiation), while blocking transverse magnetic (TM) radiation. Hydraulic isolation between the interior and exterior of the outer casing 14 is provided by an insulating structure 24, which includes an insulator 26 formed in the shape of a cylindrical tube or sleeve to encapsulate the slotted station 20. The insulator 26 may be slid over the slots 22 with one or more O-rings (not shown) providing a seal with the outer casing 14. It will be appreciated that the insulator 26 may alternatively be placed inside the outer casing 14, rather than outside, if so desired.

The insulator 26 is composed of an insulating material to permit the passage of EM radiation through the axial slots 22 of the slotted station 20. In accordance with one embodiment, the insulating materials may include a class of polyetherketones or other suitable resins. For example, fiberglass-epoxy, PEK and PEEK are dielectric materials or resins that permit the passage of signal energy including electromagnetic radiation. Victrex USA, Inc. of West Chester, PA manufactures one type of insulating material called PEEK. Cytec Fiberite, Green Tweed, and BASF market other suitable thermoplastic resin materials. Another insulating material is Tetragonal Phase Zirconia ceramic (TZP), manufactured by Coors Ceramics of Golden, CO. Certain types of insulating materials are more effective depending on the various types of applications. For example, PEEK may be used for applications involving higher shock and lower differential pressures, while TZP will typically withstand higher differential pressure, but lower shock levels. PEEK withstands high-pressure loading. Ceramics typically withstand substantially higher loads and are used in applications where shock is minimal.

Protective wear bands 28 are mounted on the outer casing 14 above and below the insulator 26. The wear bands 28 protect the insulator 26 on the trip into the well, retaining the insulator 26 in position over the axial slots 22. The wear bands 28 may be mounted on the casing 14 in accordance with several known methods established in the art, such as by spot welding, the use of fasteners, etc.

Figure 3:
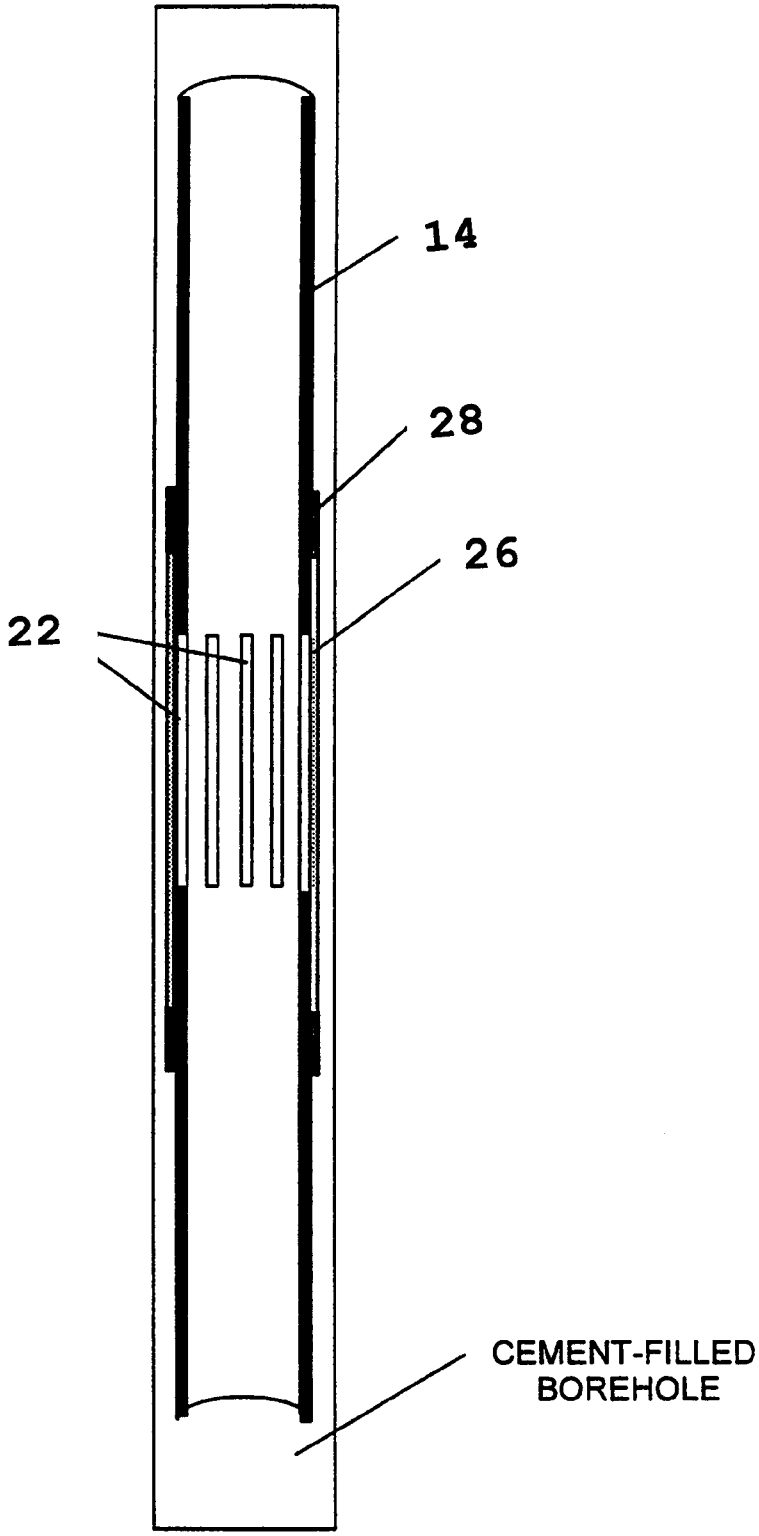
FIG. 3 shows a cross-sectional view of the outer casing of FIG. 2.

FIG. 3 shows the outer casing 14 in cross-sectional view. The insulator 26 provides a pressure barrier for the cementing operation, and for the latter production of oil and gas. In an exemplary embodiment, for a 12¼ inch borehole, the outer diameter of the permanent casing 14 may be 9⅝ inches. The outer diameter of the insulator 26 may be 10½ inches, and the outer diameter of the wear bands 28 may be 10¾ inches. Of course, it will be appreciated that these dimensions may be larger or smaller without departing from the scope of the invention.

In accordance with the illustrated embodiment, the slotted station 20 is configured with multiple slots 22 penetrating the outer casing 14, with each slot being 24 inches long and ¼ inch wide. It will be appreciated, however, that the slotted station 20 may be implemented with as few as one slot 22. It should be noted, however, that as the number of slots 22 increases, the structural integrity of the outer casing 14 might decrease. Additionally, the longer the axial slots 22 are in length, the lower the attenuation of TE radiation. Increasing the number of axial slots 22 also reduces the attenuation of TE radiation. Of course, one would readily recognize that increasing the length of the slots 22 as well as the number of slots 22 may further compromise the structural integrity of the outer casing 14. Accordingly, a balance between the structural integrity of the outer casing 14 and the minimum amount of attenuation on TE radiation caused as a result of the length and number of slots 22 should be realized.

Figure 4:
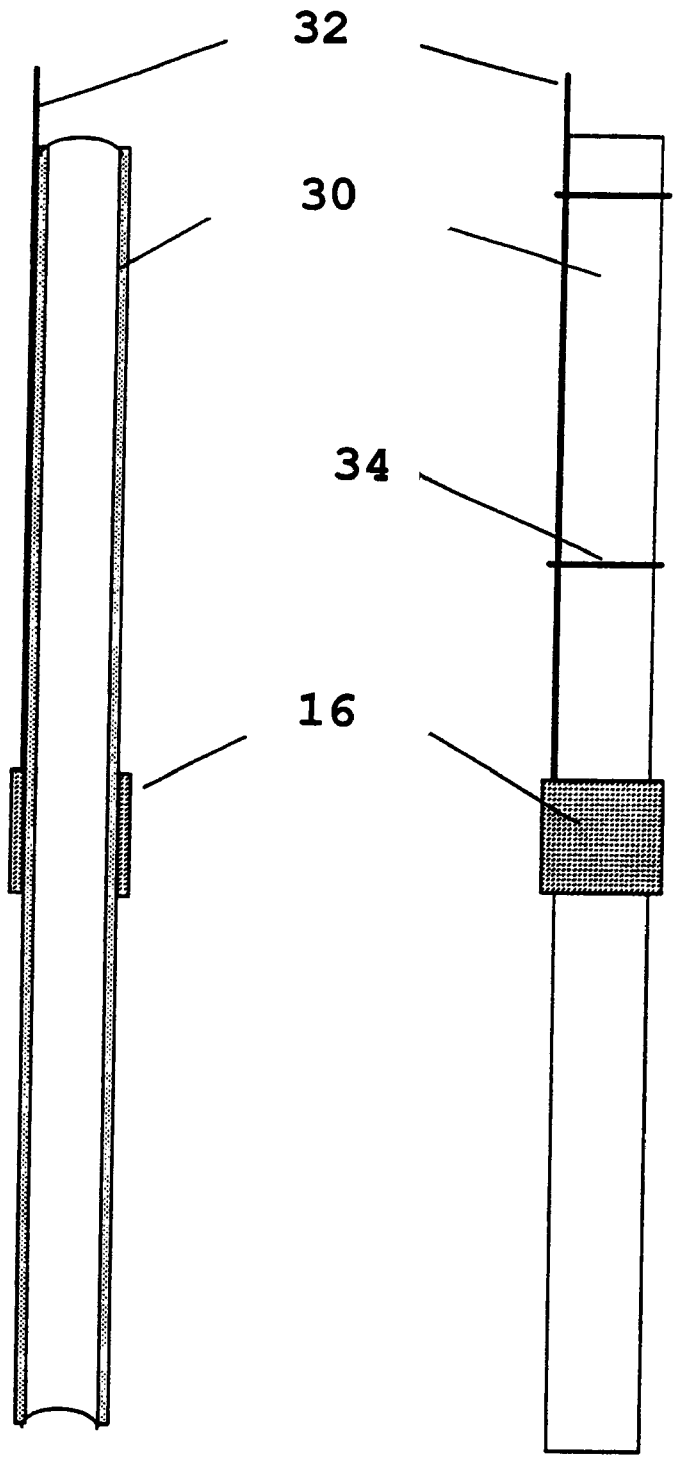
FIG. 4 shows a cross-sectional view of an inner casing with an EM receiver mounted thereon.

Turning now to FIG. 4, a cross-sectional view of an inner temporary casing 30, which is disposed within the outer casing 14, is provided. In accordance with one embodiment, the outer diameter of the inner casing 30 may be 7 inches with the outer casing 14 having an outer diameter of 9⅝ inches, for example. Of course, it will be appreciated that the diameters of the outer casing 14 and the inner casing 30 may be larger or smaller than the aforementioned dimensions without departing from the scope of the invention.

The inner casing 30 extends from the slotted section 15 of the outer casing 14 to the drilling surface. According to the illustrated embodiment, a downhole EM receiver 16 is mounted on the outer surface of the inner casing 30, which may include downhole electronics such as impedance matching circuits, amplifiers, filters, pulse shapers, and cable drivers to boost the received signals from the EM waves and filter and shape the signals.

According to one embodiment, the EM receiver 16 is coupled to a wireline 32 that runs along the outer surface of the inner casing 30 and extends to the drilling surface. In accordance with one embodiment, the wireline 32 may provide AC or DC power to the EM receiver 16, as well as allow the transmission of data signals from the EM receiver 16 to the drilling surface and vice-versa. In this particular embodiment, the wireline 32 may be tethered to the inner casing 30 approximately every 30 feet using straps 34 or other suitable means as known in the art.

Figure 5:
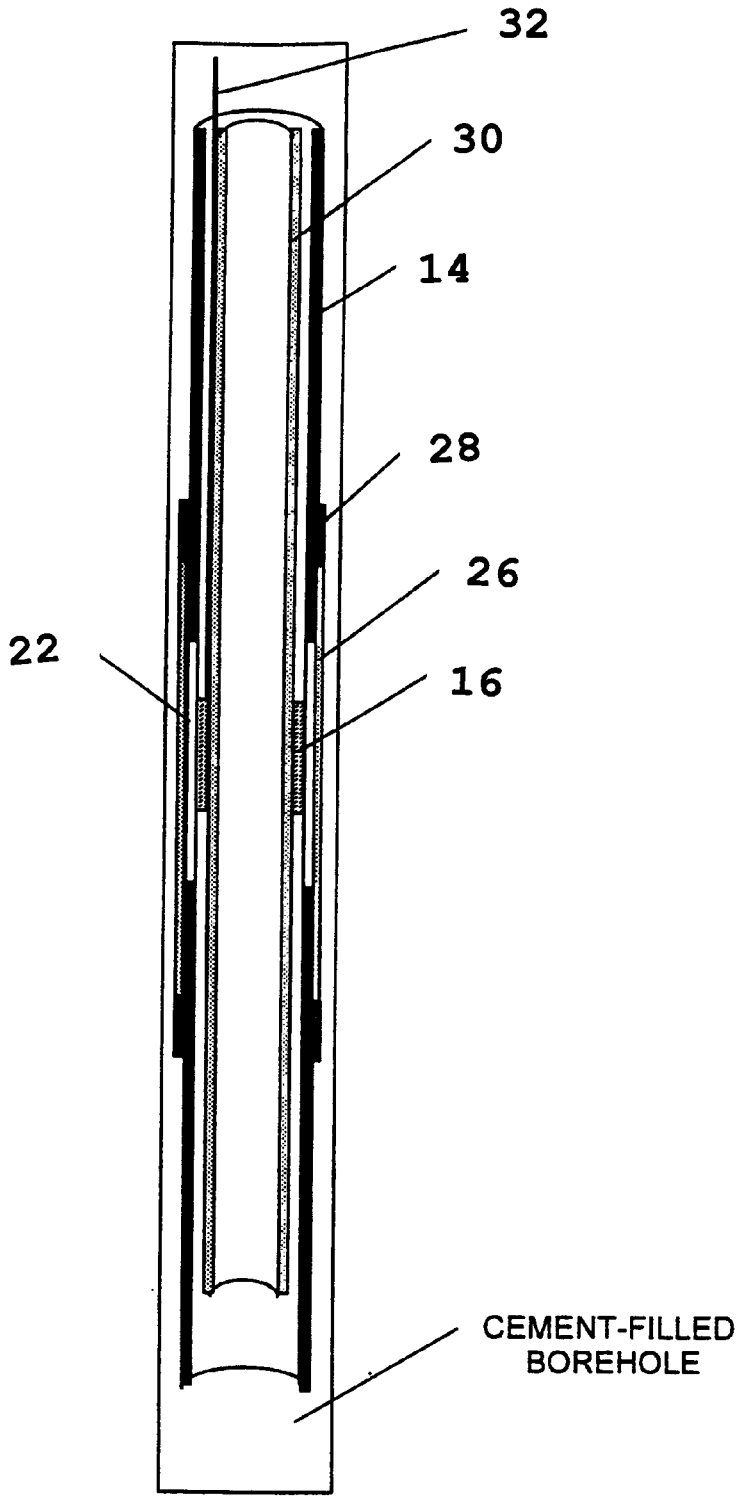
FIG. 5 illustrates a cross-sectional view of the inner casing of FIG. 4 disposed within the outer casing of FIG. 2.

Referring to FIG. 5, a cross-sectional view of the inner casing 30, as shown disposed within the outer casing 14, is provided. According to the illustrated embodiment, the downhole EM receiver 16 mounted on the inner casing 30 is positioned underneath the axial slots 22 in the outer casing 14 by interlocking mechanics (not shown), which will ensure alignment between the EM receiver 16 and the slots 22 to facilitate the passage of EM waves to the EM receiver 16.

Figure 6:
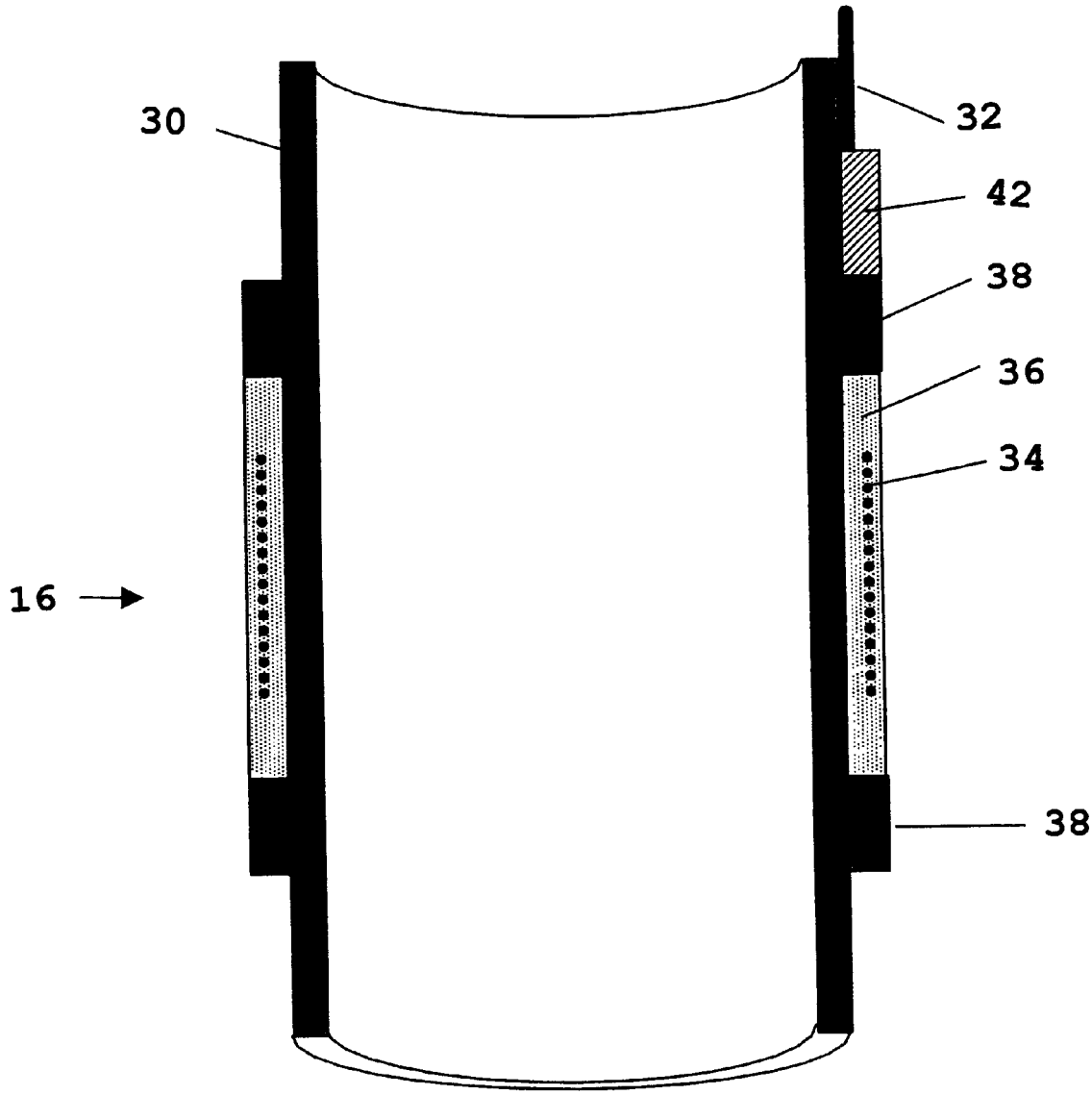
FIG. 6 shows more detailed representation of the EM receiver mounted on the inner casing of FIG. 4.

FIG. 6 shows a cross-sectional view of the downhole EM receiver 16 mounted on the inner casing 30. The EM receiver 16 includes a multiple-turn coil 34 embedded in an insulator 36. At each end of the insulator 36, there is a metallic centralizer 38, which functions to protect the insulator 36. Downhole electronics 42, such as impedance matching circuits, amplifiers, filters, pulse shapers, and cable drivers are also coupled to the outer surface of the inner casing 30. The downhole electronics 42 perform signal conditioning and amplification for transmitting data to the surface via the wireline 32. It will be appreciated that the electronics 42 used for such signal conditioning and amplification is well established to those of ordinary skill in the art. Accordingly, the specific circuitry to accomplish such conditioning and amplification of signals is not disclosed herein to avoid unnecessarily obscuring the invention.

According to one embodiment, a layer of fiberglass-epoxy is applied to the outer surface of the inner casing 30 and cured. The coil 34 is then wound over the fiberglass-epoxy layer around the outer surface of the inner casing 30. A second layer of fiberglass-epoxy is then applied and cured. Subsequently, a layer of rubber may be molded over the assembly to provide a pressure-tight, water barrier. In addition, a shield (not shown) as described in U.S. Pat. No. 4,949,045 (assigned to the present assignee) may be mounted over the coil 34 to provide for additional mechanical protection to the assembly.

Figure 7:
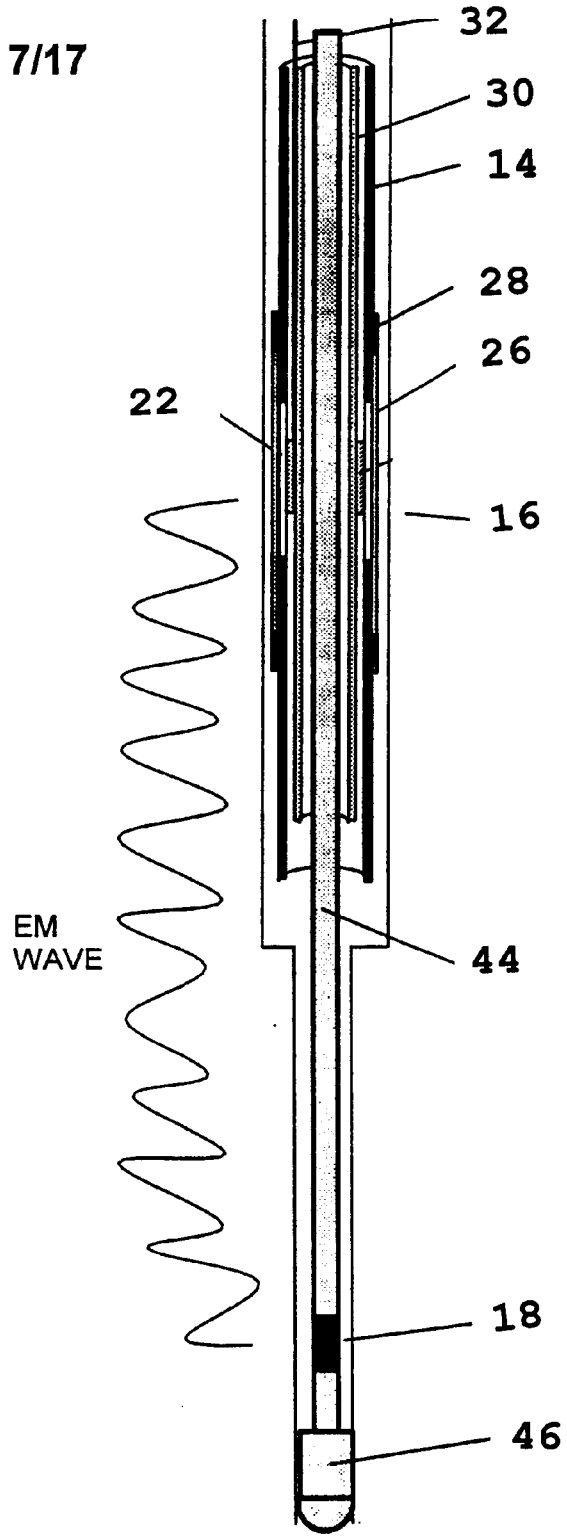
FIG. 7 depicts a cross-sectional view of an entire downhole configuration including the inner and outer casings.

Turning now to FIG. 7, a cross-sectional view that illustrates the entire downhole configuration, including the outer casing 14, the temporary inner casing 30, a drill pipe 44, a drill bit 46 and the EM transmitter 18 is provided. According to one embodiment, the EM transmitter 18 broadcasts a TE wave, which travels to the slotted section 15 of the outer casing 14. A portion of the TE wave penetrates the outer casing 14 via the axial slot(s) 22 formed therein, and is detected by the downhole EM receiver 16 residing within the outer casing 14. After amplification and conditioning by the downhole electronics 42, the data that is received by the EM receiver 16 is sent to the surface via the wireline 32, which runs along the outer surface of the inner casing 30.

Figure 8:
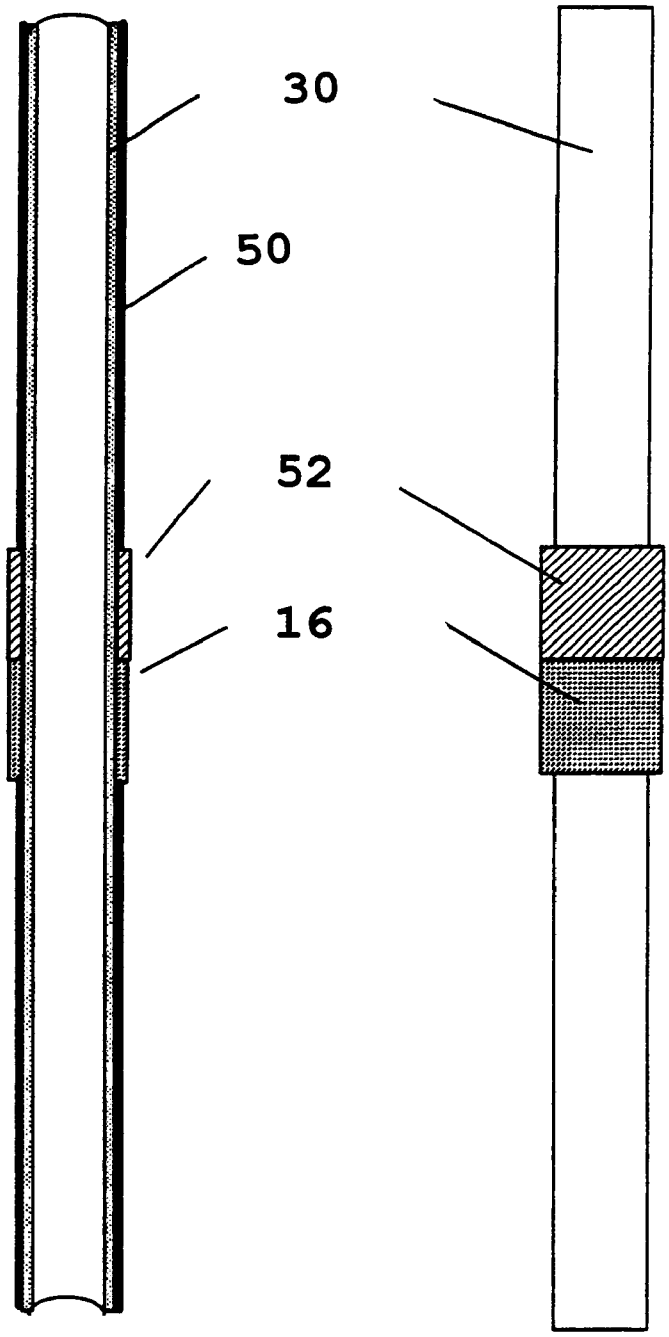
FIG. 8 shows a cross-sectional view of the inner casing with the EM receiver mounted thereon according to another embodiment of the present invention.

Now referring to FIG. 8, a cross-sectional view of the inner casing 30, which is configured in accordance with another embodiment, is shown. Under certain circumstances, it may not be either practical or possible to run the wireline 32 from the EM receiver 16 to the drilling surface as provided in the previous embodiments. Thus, according to this alternative embodiment, the inner casing 30 may be configured with an outer layer of insulating material 50, such as fiberglass-epoxy, for example, applied on the outer surface of the inner casing 30. It will be appreciated that other insulating materials may be used to coat the outer surface of the inner casing 30 in lieu of fiberglass epoxy.

Accordingly, the inner casing 30 and outer casing 14 act as a coaxial line, with the inner casing 30 acting as the inner conductor, and the outer casing 14 acting as the outer conductor. The centralizers 38 (shown in FIG. 6) that reside between the inner casing 30 and the outer casing 14 are also covered with the insulating material 50. It will be appreciated that the electromagnetic transmission characteristics of a pair of isolated concentric tubulars are improved if the annular fluid between them is non-conductive, such as oil or synthetic based fluid, for example. Furthermore, it will be appreciated that a second antenna (not shown) may be needed to drive signals on the coaxial system. A battery pack 52 may also be provided in this configuration to provide power to the downhole electronics 42 that is resident within the EM receiver 16.

In the embodiments discussed heretofore, the slots 22 on the outer casing 14 have had an axial (i.e., non-tilted) orientation to maximize the generation and reception of TE waves. In certain applications, however, it may be desirable to generate TM waves rather than TE waves. TM waves typically provide additional information that may be used to monitor the formation around the outer casing 14.

Figure 9:
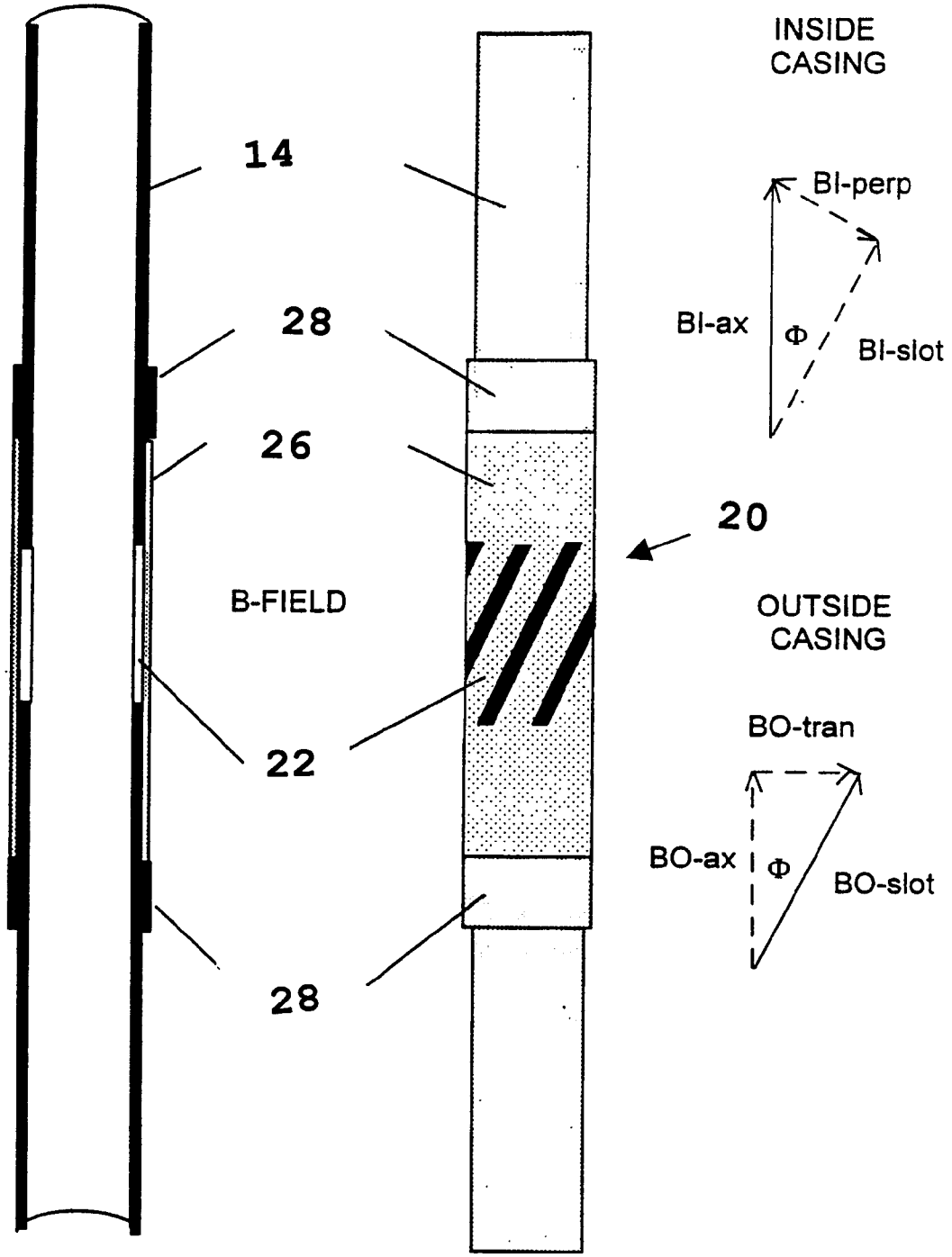
FIG. 9 shows a cross-sectional view of the outer casing configured with a plurality of non-axial slots formed therein according to another embodiment.

Turning now to FIG. 9, a configuration for generating and receiving TM waves with non-axial (i.e., tilted) slots 22 formed in the outer casing 14 is shown. In this particular configuration, the same EM receiver 16 antenna (not shown) that was used for generating and receiving TE waves is also used. For simplicity sake in illustrating the present invention, the following analysis refers to the case where the EM receiver 16 is transmitting. However, by the principle of reciprocity, the results are equally valid for the case where the EM receiver 16 is receiving.

Inside the casing, the antenna of the EM receiver 16 produces a TE field that has an axial magnetic field (BI-ax) at the inner surface of the outer casing 14. This magnetic field may be expressed as the vector sum of a magnetic field parallel to the slot (BI-slot) and a magnetic field perpendicular to the slot (BI-perp). If the angle between the slot 22 and the casing 14 is $\phi$, then BI-slot=BI-ax cos($\phi$). This component is slightly attenuated by the slot 22, but produces an external magnetic field BO-slot=$\alpha$ BI-slot, where $\alpha$ is the scaling factor. This external field may be decomposed into external magnetic fields parallel to the outer casing 14 axis (BO-ax) and transverse to it (BO-tran), where BO-ax=BO-slot cos($\phi$) and BO-tran=BO-slot sin ($\phi$). This axial magnetic field is associated with a TE field external to the casing 14, while the transverse magnetic field is associated with a TM wave. Hence:

$$BO\text{-tran}=\alpha/2\ BI\text{-ax}\ \sin(2\phi)\ \text{and}\ BO\text{-ax}=\alpha BI\text{-ax}\ \cos^2(\phi).$$

The transverse magnetic field is maximum at $\phi$=45° where the two components are also equal in magnitude, and zero at $\phi$=0° and 90°.

The axial magnetic field produces TE radiation, while the transverse magnetic field produces TM radiation. The slotted station 20 to let pass the desired TM-field wave, and attenuate the undesired components, should have at least one sloped slot 22 that is sloped at an angle $\phi$ with respect to the outer casing 14 axis. If there are multiple slots 22 (as depicted in FIG. 9) at the same angle $\phi$, then the axial components sum to an effective vertical magnetic dipole, and the transverse components sum to an azimuthal magnetic source equivalent to a vertical electric dipole.

While both TE and TM radiation are present, TM radiation will generally be guided along the outer casing 14 and be less attenuated than the TE radiation, resulting in a larger signal at the EM receiver 16 within the sloped-slot station 20. Thus, by aligning an axial antenna of the EM receiver 16 within the sloped-slotted station 20, TM field waves may be produced. It will be appreciated that the invention is also effective with the antenna 16 disposed within the outer casing 14 with its axis at an angle with respect to the outer casing 14 axis.

The slotted station 20 or the antenna of the EM receiver 16 may be constructed to alter the tilt angle of the magnetic dipole with respect to the axial direction. Combinations of sloped and axial slots 22 of varying length, orientation, symmetry, and spacing may be formed on the outer casing 14 wall. The sloped slots 14 may have equal or varied slope angles with respect to the casing 14. The slots 22 may also be cut into a curved pattern (instead of straight) within the outer casing 14 wall. It will be appreciated by those skilled in the art having the benefit of this disclosure that other modifications may be employed to increase the efficiency of the slotted station 20.

In the previously described embodiments, the EM receiver 16 is mounted on the outer surface of the inner casing 30 and the EM waves (both TE and TM) are passed through either the axial or non-axial slots 22 in the outer casing 14 wall. While this configuration provides protection to the EM receiver 16 since it resides within the outer casing 14, it may compromise the structural integrity of the outer casing 14 wall. That is, the more slots 22 and/or an increase in the size of the slots 22 may cause undesirable deterioration of the structural integrity of the outer casing 14.

Figure 10A:
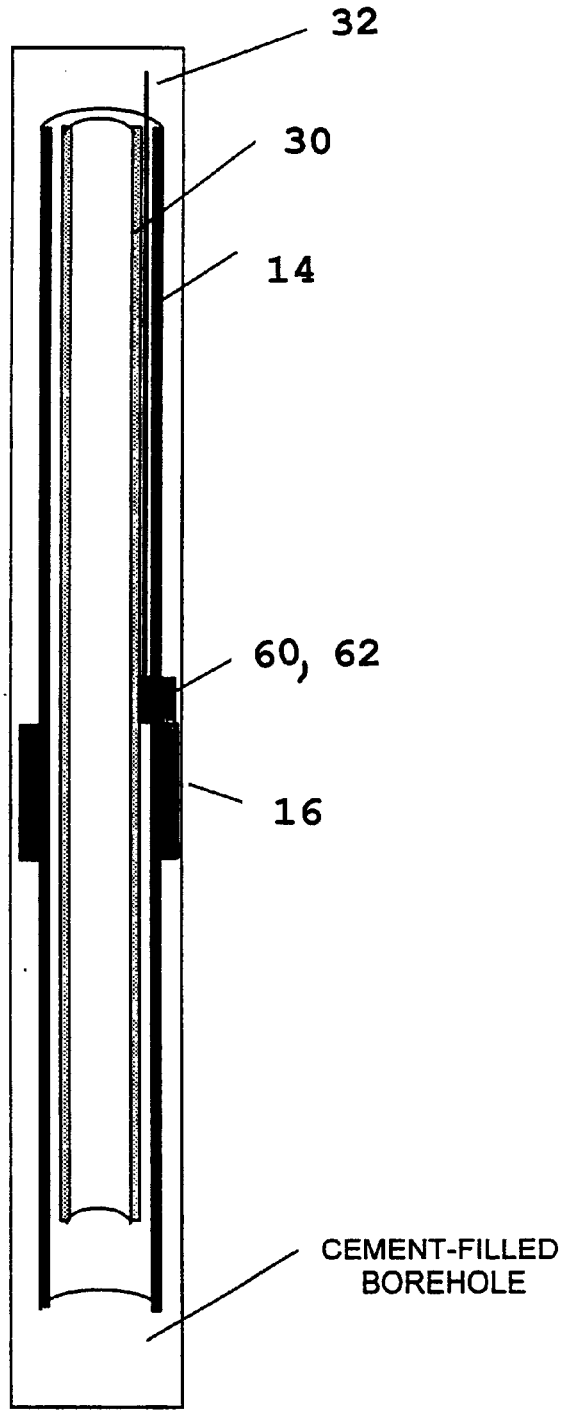
FIGS. 10A–C and 11 show a cross-sectional view of the inner and outer conductors with the EM receiver being mounted on the outer casing and an inductive coupler arrangement for transferring signals received from the EM receiver.
Figure 11:
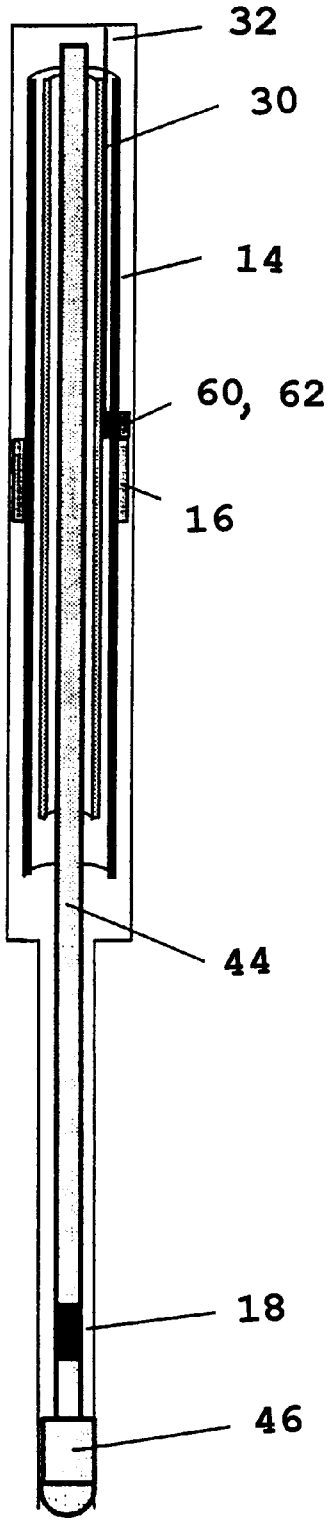

Turning now to FIG. 10A, an alternative mounting scheme for the EM receiver 16 is shown in accordance with another embodiment of the present invention. In this alternative embodiment, the EM receiver 16 may be permanently mounted on the outside surface of the outer casing 14 as opposed to being mounted on the inner casing 30. FIG. 11 shows the entire downhole configuration with the EM receiver 16 mounted on the outer casing 30.

Figure 10B:
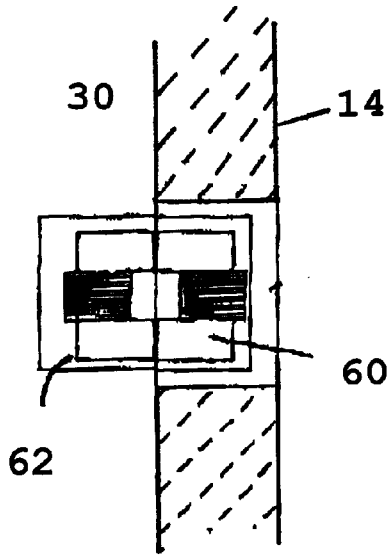

Referring to FIGS. 10A and 10B, an inductive coupler 60 is provided on the outside surface of the outer casing 14 that conveys signals received by the EM receiver 16 to the wireline 32 that runs along the outer surface of the inner casing 30 to the drilling surface. The inner casing 30 has a mating inductive coupler 62 attached to its outer surface to receive the signals from the EM receiver 16 via the inductive coupler 60 mounted on the surface of the outer casing 14. The mating inductive coupler 62 on the surface of the inner casing 30 is coupled to the wireline 32 for carrying the signals received from the EM receiver 16 mounted on the outer casing 14. In an alternative embodiment, signals received from the wirelink 32 may be transferred to the EM receiver 16 via the couplers 60, 62 (i.e., in a reverse direction).

When using the inductive couplers 60, 62 for transmitting signals from the EM receiver 16 to the wireline 32, it is important that the two inductive couplers 60 and 62 match up with one another (i.e., are located proximate to each other) when the inner casing 30 is disposed within the outer casing 14. In one embodiment, the correct depth and azimuthal juxtaposition of these inductive couplers 60, 62 may be achieved with a mechanical locating device. For example, a landing stub (not shown) in the outer casing 14 whose inside surface has an internal or negative profile, may be located by the inner casing 30 whose inside surface has a matching external or positive profile. The use of these positive and negative profiles would preserve the hydraulic integrity of both the outer casing 14 and inner casing 30. The use of mechanical locating devices may also be combined with a third completion element such as a packer set (not shown) in the outer casing 14 with a sealing bore provided for the inner casing 30.

The inner casing 30 is eccentered inside the outer casing 14 so that the inductive coupler 62 of the inner casing 30 and the inductive coupler 60 on the outer casing 30 are within close proximity. Hence, correctly positioning the inner casing 30 inside the outer casing 14 is important to achieve good efficiency in the inductive coupling. Proper positioning may be accomplished using a stinger and landing shoe mechanism (not shown) with an eccentering system, for example.

In accordance with one embodiment, the inductive couplers 60, 62 have "U" shaped cores made of ferrite. Typically, there is a gap between the inductive couplers 60, 62 in the outer and inner casing 14, 30, so that coupling will not be 100% efficient. To improve the coupling efficiency of the inductors 60, 62, and to reduce the effects of misalignment of the pole faces, it is desirable that the pole faces of the inductive couplers 60, 62 have as large of a surface area as possible.

Figure 10C:
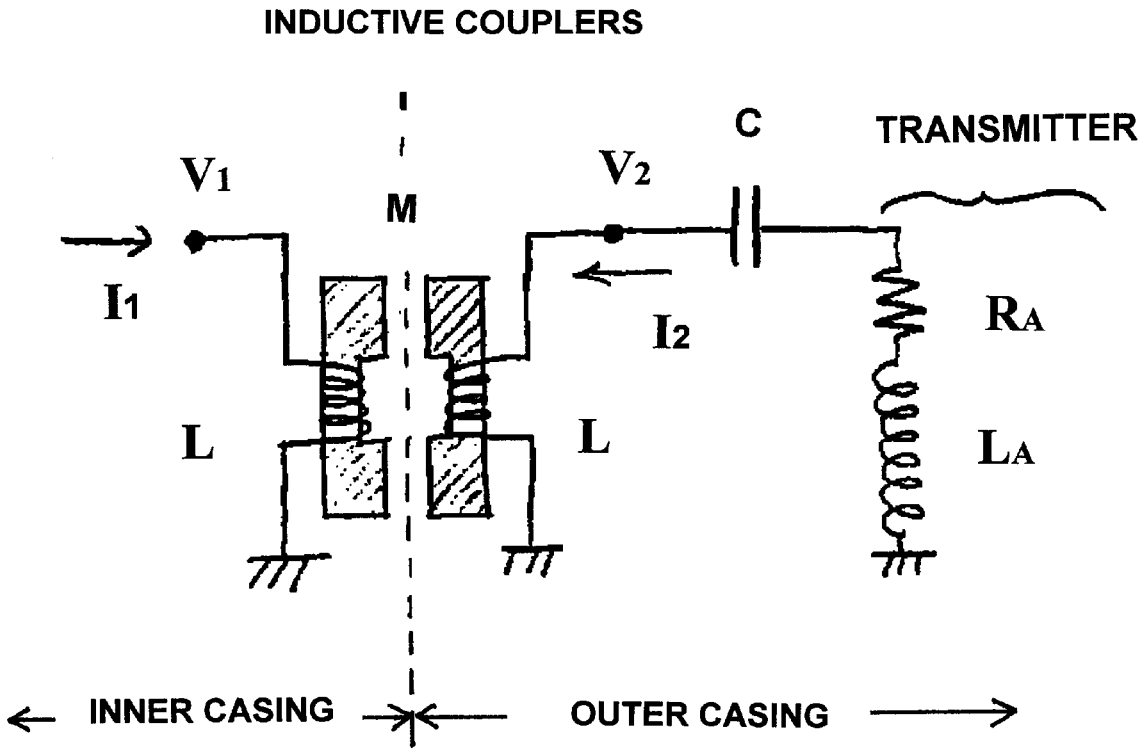

Turning to FIG. 10C, a circuit is provided for the inductor coupler arrangement 60, 62 and a transmitter antenna. On the inner casing side, the current is $I_2$ and the voltage is $V_1$, while on the outer casing side, the current is $I_2$ and the voltage is $V_2$. The mutual inductance is M, and the self-inductance of each half is L. The inductive coupler arrangement 60, 62 is symmetric with the same number of turns on each half. With the direction of $I_2$ defined in the figure, the voltages and currents are related by $V_1=j\omega LI_1+j\omega MI_2$ and $V_2=j\omega MI_1=j\omega LI_2$. The antenna impedance is primarily inductive ($L_A$) with a small resistive part ($R_A$), $Z_A=R_A+j\omega L_A$. Typically, the inductive impedance is about 100 ohms, while the resistive impedance is about 1 ohm. A tuning capacitor (C) may be used to cancel the antenna inductance, giving the outer casing side impedance $Z_2=R_A+j\omega L_A-j/\omega C\sim R_A$. The ratio of the current delivered to the antenna to the current driving the inductive coupler is $I_2/I_1=-j\omega M/(j\omega L+R_A+j\omega L_A-j\omega/C)$. The inductive coupler has many turns and a high permeability core, so $L >> L_A$ and $\omega L >>> R_A$. To good approximation, $I_2/I_1=\sim-M/L$.

From this calculation, two observations may be realized. First, for a perfect inductive coupler, M=L, and the current is not attenuated. However, realistically inductive couplers, the gap between the pole faces will result in lost magnetic flux, and therefore M<L. With reasonable dimensional tolerances, one would expect M/L~0.5–0.8, or 2–6 dB insertion loss. Second, it should be possible to tune the transmitter with the tuning capacitor placed on the outer casing side of the circuit. Changes in M will not affect the tuning condition: $\omega^2 L_A C=1$. Other tuning elements (N:1 transformers, additional capacitors, etc.) may be placed in the inner casing 30.

Figure 12:
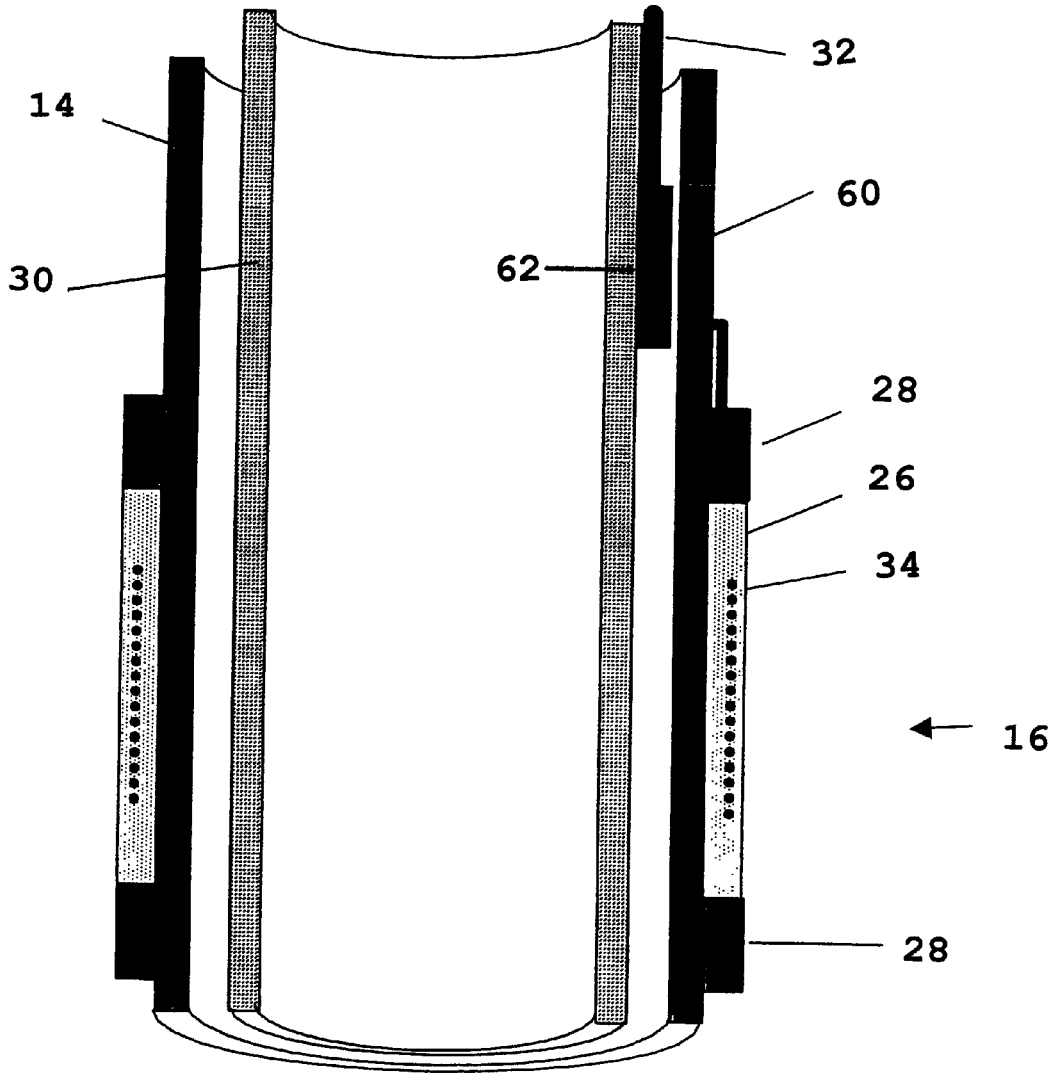
FIGS. 12 and 13 show a more detailed view of the EM receiver with the inductive coupler arrangement.

Turning now to FIG. 12, a cross-sectional view of the downhole EM receiver 16 mounted on the outer surface of the outer casing 14 is shown. In this particular embodiment, the EM receiver 16 is configured to detect TE waves. The EM receiver 16 includes a multiple-turn coil 34 embedded in an insulator 26. At each end of the insulator 26, there is a wear band 28, which functions to protect the insulator 26 on the trip into the well. According to one embodiment, a layer of fiberglass-epoxy is applied to the outer surface of the inner casing 30 and cured. The coil 34 is then wound over the fiberglass-epoxy layer around the outer surface of the inner casing 30. A second layer of fiberglass-epoxy is then applied and cured. Finally, a layer of rubber may be molded over the assembly to provide a pressure-tight water barrier.

The inductive coupler 60 is mounted on the outer casing 14 and is coupled to the EM receiver 16. The complimenting inductive coupler 62 is mounted on the inner casing 30 and is connected to the wireline 32. When the inductive couplers 60 and 62 are matched, the signals received via the EM receiver 16 are then sent via the wireline 32 to the drilling surface.

Figure 13:
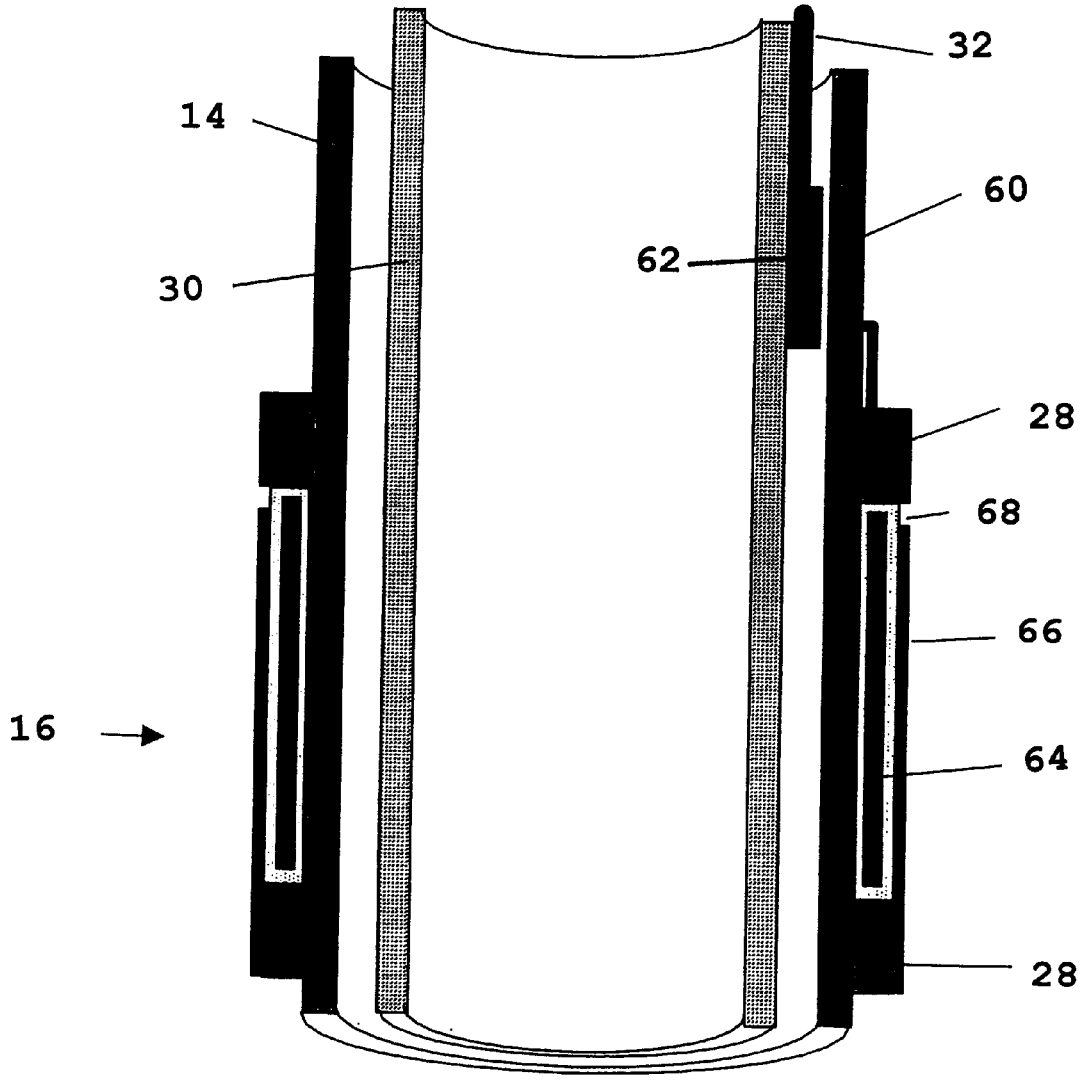

Turning now to FIG. 13, a cross-sectional view of the downhole EM receiver 16 mounted on the outer casing 14 is shown in accordance with another embodiment of the present invention. In this particular embodiment, the EM receiver 16 is configured to receive TM waves from the EM transmitter 18 as opposed to TE waves (as discussed in the configuration shown in FIG. 12). The EM receiver 16 mounted on the outer casing 14 includes a toroid 64 mounted between wear bands 28. The wear bands 28 function to protect the toroid 64, especially while making the trip into the well. Additional protection for the toroid 64 is provided by a shield 66 that is coupled to one of the wear bands 28. A gap 68 is provided between one of the wear bands 28 and the shield 66 to permit passage of the TM waves to the toroid 64.

Similar to the arrangement of FIG. 12, the inductive coupler 60 is mounted on the outer casing 14 and is coupled to the EM receiver 16. The complimenting inductive coupler 62 is mounted on the inner casing 30 and is connected to the wireline 32. When the inductive couplers 60 and 62 are matched, the signals received via the toroid 64 are sent via the wireline 32 to the drilling surface.

In accordance with another embodiment of the invention, it will be appreciated that wet-stab connectors may be used in lieu of the inductive couplers 60, 62 as discussed above. And, according to yet another embodiment, as opposed to having the inductive coupler 62 of the inner casing 30 coupled directly to the wireline 32, the outside surface of the inner casing 30 may be covered with an insulating material, and itself used as the wire to the drilling surface. In accordance with one embodiment, the insulating material may be fiberglass-epoxy, for example. The EM transmission characteristics of a pair of insulated concentric tubulars are typically improved if the annular fluid between them is non-conductive, such as oil or synthetic based fluid.

Figure 14A:
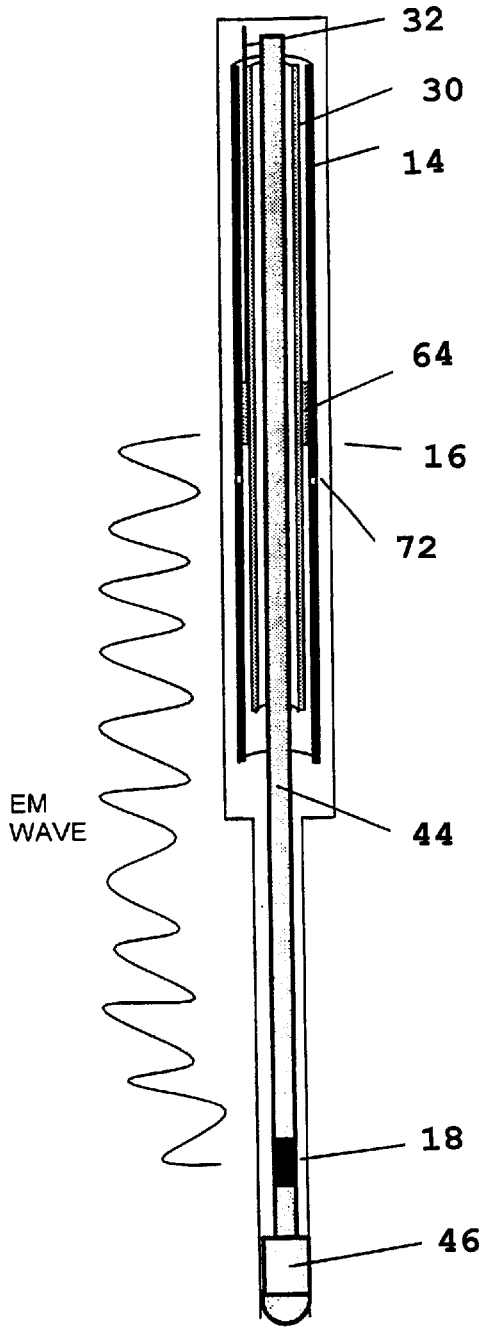
FIGS. 14A and B illustrate a cross-sectional view of an outer casing having an insulated gap formed therein in accordance with another embodiment of the present invention.
Figure 14B:
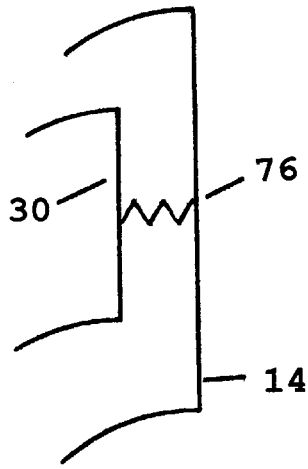

Turning now to FIG. 14A, a downhole arrangement is provided according to another embodiment of the invention. In this particular embodiment, the outer casing 30 wall includes an insulated gap 72 so as to focus current onto the interior conductors. The inner casing 30 is electrically connected to the outer casing 14 via a spring-loaded device 76 (shown in FIG. 14B) that can be retracted if the inner casing 30 needs to be withdrawn from the outer casing 14. It will be appreciated, however, that other types of retracting devices may be used to electrically couple the inner casing 30 to the outer casing 14 in lieu of the spring-loaded device 76.

Beneath the electrical connection provided by the spring-loaded device 76 is a toroid 64, which is mounted on the inner casing 30. The toroid 64 is used to measure the axial current passing along the inner casing 30. Such current will return down the casing 30 and return to the drill pipe 44. The current return may be through the mud if it is conductive, as well as across any points of contact between the drill pipe 44 and the outer casing 14.

Figure 15:
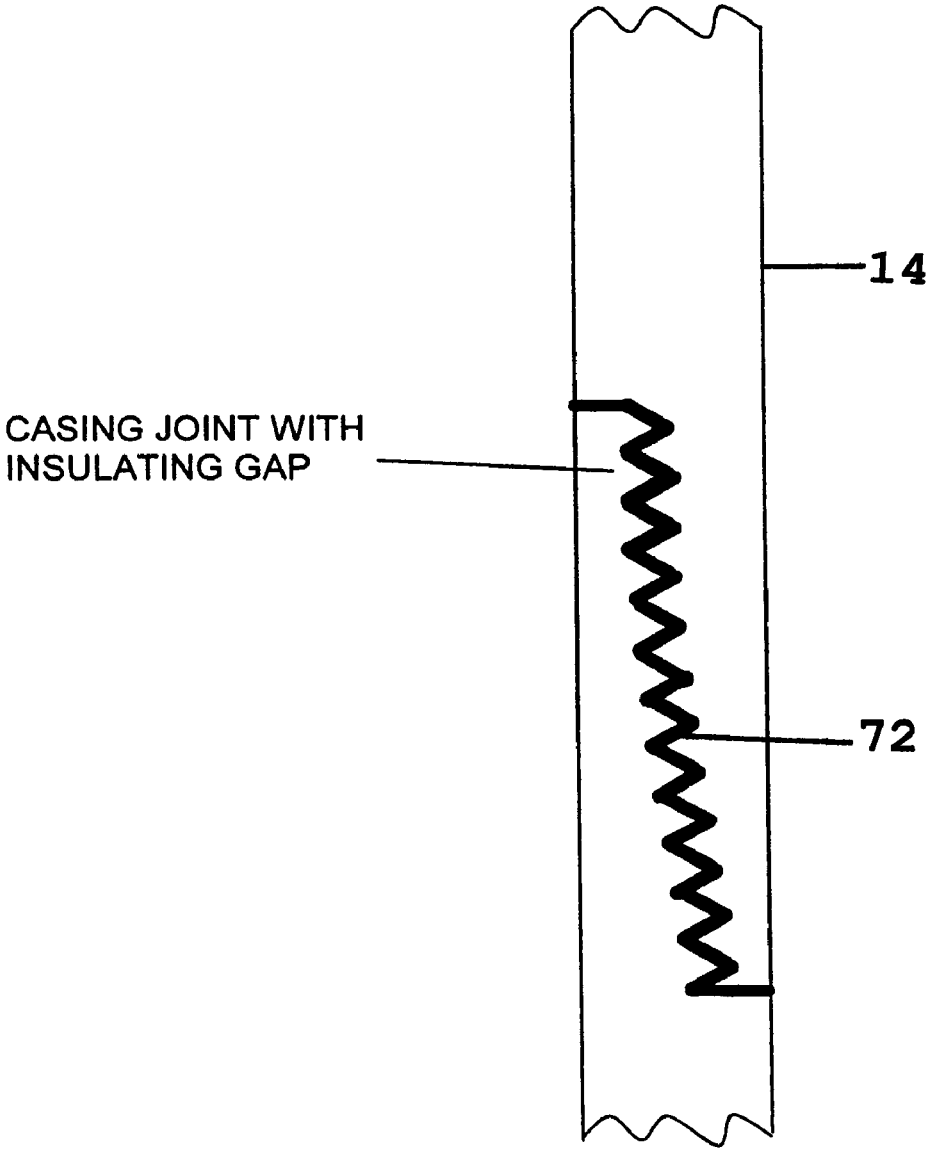
FIG. 15 shows a more detailed prospective of the insulated gap formed in the outer casing of FIG. 14A.

FIG. 15 shows a detailed perspective for the insulated gap 72 in the outer casing 14 wall. A thread separates two pieces of the outer casing 14 and the thread is coated with some suitable insulating material. According to one embodiment, the insulating material may include a plasma-sprayed layer of alumina or zirconium, for example. To ensure adequate insulation provided by the insulating gap 72, the plasma-sprayed layer may itself be coated with an epoxy or insulating polymer to seal any pores within the plasma-sprayed coating.

Figure 16:
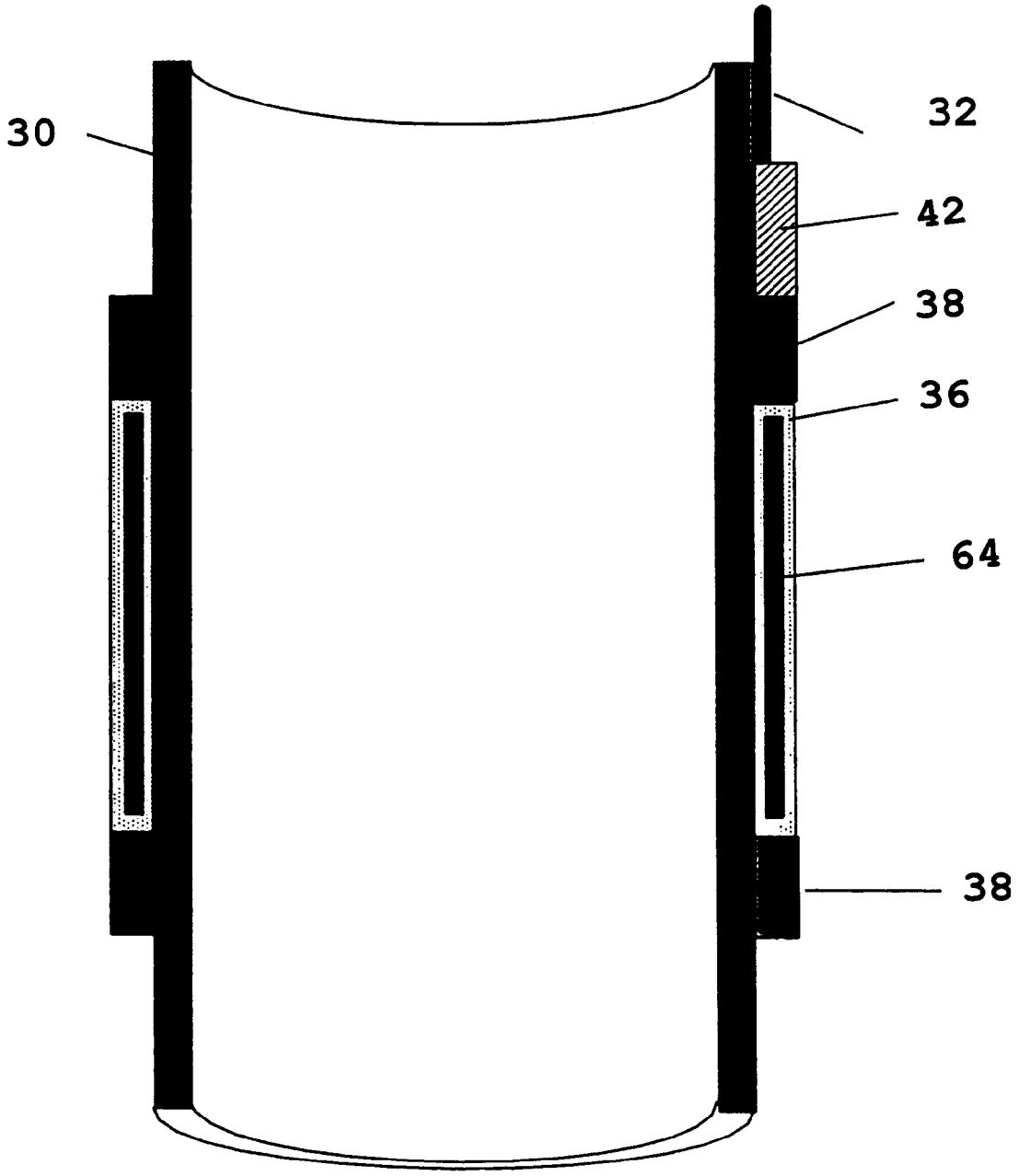
FIG. 16 depicts a more detailed perspective of the EM receiver mounted on the inner casing in a configuration suitable for the insulated gap arrangement in the outer casing of FIG. 14A.

Turning now to FIG. 16, a more detailed representation of the EM receiver 16 that is mounted on the outer surface of the inner casing 30 is provided. The inner casing 30 is secured in place via two centralizers 38, which are positioned above and below the receiving toroid 64. The function of the centralizers 38 are to protect the toroid 64 while the inner casing 30 is disposed in the outer casing 14. Additionally, the upper centralizer 38 acts as a current path from the outer casing 14 to the inner casing 30. Current may leave from the inner casing 30 across the lower centralizer 38, but this will not significantly affect the signal on the toroid 64. In accordance with one embodiment, the largest signal would be obtained if the upper centralizer 38 was placed slightly above the insulated gap 72 in the outer casing 14 wall and the lower centralizer 38 was placed slightly below the insulated gap 72.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope of the invention as set forth in the appended claims.

What is claimed is:

1. A downhole telemetry system, comprising:

a first tubular disposed within a borehole, the first tubular having an elongated body and including at least one slot formed in a portion thereof;

a second tubular being disposed within the first tubular; and a receiver adapted to receive a signal, the receiver being mounted on the outer surface of the second tubular within the first tubular such that the receiver is aligned with the at least one slot formed in the first tubular.

2. The system of claim 1, wherein the slotted portion of the first tubular comprises an isolation sleeve mounted around the outer surface of the first tubular, the isolation sleeve providing hydraulic isolation at the at least one slot.

3. The system of claim 1, further comprising a transmitter adapted to transmit the signal received by the receiver.

4. The system of claim 1, wherein the signal received comprises electromagnetic energy.

5. The system of claim 1, wherein the receiver comprises a multiple-turn coil for receiving the signal.

6. The system of claim 1, further comprising a wireline coupled to the receiver and attached to the outer surface of the second tubular, the wireline adapted to carry the received signal from the receiver to a remote location.

7. The system of claim 1, wherein the second tubular has an insulating material disposed on its outer surface and is adapted to carry the received signal from the receiver to a remote location.

8. The system of claim 1, wherein the at least one slot formed on the first tubular is sloped at an angle with respect to the longitudinal axis of the first tubular.

9. The system of claim 1, wherein the receiver comprises a transceiver adapted to transmit and receive signals.

10. A method for downhole telemetry, comprising:

disposing a first tubular within a borehole, the first tubular including at least one slot formed in a portion thereof;

disposing a second tubular within the first tubular, the second tubular having at least one receiver mounted on its outer surface;

positioning the second tubular within the first tubular such that the at least one receiver is aligned with the slotted portion of the first tubular; and receiving a signal at the at least one receiver.

11. The method of claim 10, further comprising transmitting by a transmitter the signal received by the receiver.

12. The method of claim 10, wherein receiving a signal at the at least one receiver further comprises receiving an electromagnetic signal at the at least one receiver.

13. The method of claim 10, further comprising:

coupling a wireline to the receiver;

attaching the wireline to the outer surface of the second tubular; and carrying the received signal from the receiver to a remote location over the wireline.

14. The method of claim 10, further comprising:

applying an insulating material onto the outer surface of the second tubular, and carrying the received signal along the second tubular.

15. A downhole telemetry system, comprising a first tubular disposed within a borehole;

a second tubular being disposed within the first tubular, the second tubular having a wireline attached to its outer surface;

a receiver adapted to receive a signal, the receiver being mounted on the outer surface of the first tubular;

a first coupler mounted on the outer surface of the first tubular and connected to the receiver; and a second coupler mounted on the outer surface of the second tubular and connected to the wireline;

wherein the first coupler is adapted to transfer the signal received by the receiver to the wireline via the second coupler.

16. The system of claim 15, wherein the first and second couplers comprise inductive couplers.

17. The system of claim 15, wherein the second tubular is positioned within the first tubular to align the first and second couplers proximate to each other.

18. The system of claim 15, wherein the second coupler is further adapted to transfer signals received from the wireline to the receiver via the first coupler.

19. The system of claim 15, wherein the receiver comprises a transceiver adapted to transmit and receive signals.

20. The system of claim 15, wherein the signal received comprises electromagnetic energy.

21. The system of claim 15, wherein the receiver comprises a multi-turn coil adapted to receive transverse electric waves.

22. The system of claim 15, wherein the receiver comprises a toroid adapted to receive transverse magnetic waves.

23. A method for downhole telemetry, comprising:

mounting a first inductive coupler and a receiver on the outer surface of a first tubular, the first inductive coupler and receiver being connected to each other;

mounting a second inductive coupler on the outer surface of a second tubular;

disposing the second tubular within the first tubular; and receiving a first signal at the receiver and transferring the first signal from the first inductive coupler to the second inductive coupler.

24. The method of claim 23, wherein disposing the second tubular within the first tubular further comprises disposing the second tubular within the first tubular such that the first inductive coupler on the first tubular and the second inductive coupler on the second tubular are located proximate to each other.

25. The method of claim 23, further comprising mounting a wireline on the outer surface of the second tubular and connecting the second inductive coupler to the wireline.

26. The method of claim 25, further comprising transferring the received first signal to the wireline via the second inductive coupler.

27. The method of claim 25, further comprising receiving a second signal via the wireline and transferring the second signal from the second inductive coupler to the receiver via the first inductive coupler.

28. A downhole telemetry method, comprising:

mounting a first inductive coupler and a transceiver on the outer surface of a first tubular, the first inductive coupler and transceiver being connected to each other;

mounting a second inductive coupler on the outer surface of a second tubular;

disposing the second tubular within the first tubular; and receiving a first signal at the transceiver and transferring the first signal from the first inductive coupler to the second inductive coupler.

29. The method of claim 28, wherein disposing the second tubular within the first tubular further comprises disposing the second tubular within the first tubular such that the first inductive coupler on the first tubular and the second inductive coupler on the second tubular are located proximate to each other.

30. The method of claim 28, further comprising mounting a wireline on the outer surface of the second tubular and connecting the second inductive coupler to the wireline.

31. The method of claim 30, further comprising transferring the received first signal to the wireline via the second inductive coupler.

32. The method of claim 30, further comprising receiving a second signal via the wireline and transferring the second signal from the second inductive coupler to the transceiver via the first inductive coupler.

33. A downhole telemetry system, comprising:

a first tubular disposed within a borehole, the first tubular having an elongated body and including an insulated gap formed in a portion thereof;

a second tubular disposed within the first tubular, the second tubular having a receiver mounted on its outer surface; and an electrical coupling mechanism adapted to electrically couple the first tubular to the second tubular; and wherein the second tubular is positioned within the first tubular such that the electrical coupling mechanism is positioned above the receiver on the second tubular and the receiver is positioned above the insulated gap formed in the first tubular.

34. The system of claim 33, wherein the insulated gap formed in the first tubular comprises a thread that separates the first tubular into a first and second part.

35. The system of claim 34, wherein the thread is coated with an insulating material.

36. The system of claim 35, wherein the insulating material comprises a plasma-sprayed layer of alumina or zirconium.

37. The system of claim 33, wherein the receiver comprises a toroid.

38. The system of claim 33, wherein the electrical coupling mechanism comprises a spring-loaded mechanism that is retractable for electrically contacting the first and second tubulars.

39. A method for downhole telemetry, comprising:

disposing a first tubular within a borehole, the first tubular having an elongated body and including an insulated gap formed in a portion thereof;

disposing a second tubular within the first tubular, the second tubular having a receiver mounted on its outer surface, and the second tubular being positioned with the first tubular such that the receiver mounted on its surface is positioned above the insulated gap formed in the first tubular; and electrically coupling the first tubular to the second tubular, the electrical coupling occurring above the receiver mounted on the second tubular.

* * * * *